United States Patent [19]

Gonzalez

[11] 4,340,015

[45] Jul. 20, 1982

[54] FRONT TRANSFER PORT SYSTEM

[76] Inventor: Fernando C. Gonzalez, 224 N. Myers St., Burbank, Calif. 91506

[21] Appl. No.: 931,617

[22] Filed: Aug. 7, 1978

Related U.S. Application Data

[63] Continuation-in-part of Ser. No. 749,067, Dec. 9, 1976, abandoned.

[51] Int. Cl.[3] ..... F02B 33/04

[52] U.S. Cl. ..... 123/73 R; 123/65 P; 123/65 A

[58] Field of Search ..... 123/65 A, 73 R, 73 A, 123/65 P

[56] References Cited

U.S. PATENT DOCUMENTS

| | | | |
|---|---|---|---|
| 1,353,465 | 9/1920 | Edwards | 123/73 A |
| 1,983,198 | 12/1934 | Steiger | 123/65 A |
| 2,271,015 | 1/1942 | Jackson | 123/65 A |

FOREIGN PATENT DOCUMENTS

| | | | |
|---|---|---|---|
| 485292 | 10/1929 | Fed. Rep. of Germany | 123/65 A |
| 155554 | 2/1939 | Fed. Rep. of Germany | 123/65 A |
| 865233 | 7/1949 | Fed. Rep. of Germany | 123/73 A |
| 641031 | 11/1928 | France | 123/73 A |

*Primary Examiner*—Wendell E. Burns
*Attorney, Agent, or Firm*—Lewis Anten

[57] ABSTRACT

A front transfer port system to help ensure a regular cooling of the piston and cylinder temperature at the points where the heat conditions are more severe, and to improve the transfer process of the mixture that transfers from the crankcase to the cylinder with more scavenging efficiency to displace spent products to the atmosphere through the exhaust ports in an internal combustion two-stroke cycle engine. The front transfer port system is situated in the cylinder wall at the front and between the exhaust ports.

3 Claims, 3 Drawing Figures

FRONT TRANSFER PORT SYSTEM

CROSS-REFERENCE TO RELATED APPLICATION

This application is a continuation-in-part of application Ser. No. 749,067, filed Dec. 9, 1976, and now abandoned.

BACKGROUND OF THE INVENTION

1. Field of the Invention

The invention relates generally to the transfer process more particularly, but not by way of limitation, for use with internal combustion two-stroke cycle engine.

2. Description of the Prior Art

The prior art includes various types of transfer systems, the prior teachings set forth an awareness of criticality of the transfer process, since the time for filling the cylinder with fresh fuel mixture from the crankcase of a two-stroke cycle engine is short. Also the two-stroke cycle engine is difficult to cool satisfactorily, especially in the most serious areas of heat absorption in the exhaust ports and the piston crown. After a number of alternatives have been used at different times, the position of the transfer ports have to be compromised between the two situations; thus, at first the transfer ports are positioned close to either side of one or two exhaust ports, in order that most of the piston crown is cooled by the incoming charge. Secondly, the transfer ports are positioned further away from both sides of the exhaust port, in order to gain more scavenging efficiency, but this arrangement does not cool the front area of the piston crown to the same extent. A balance between the two previous situations in the practice of the transfer process is obtained with multiple transfer ports in both sides of the exhaust port or ports, when the exhaust port is divided by one or more bridges. Attention is directed to German Pat. No. 865,233, Feb. 2, 1953, and U.S. Pat. No. 2,816,529, Dec. 17, 1957, for examples.

SUMMARY OF THE INVENTION

The present invention contemplates the front transfer port system for use with internal combustion two-stroke cycle engines of different size and horsepower. In a more limited aspect, the innovation consists of a front transfer port system to improve the transfer process and cooling of an internal combustion two-stroke cycle engine. The front transfer port system comprises a main transfer port located in the cylinder wall between two exhaust ports. In the preferred form, the transfer port and the exhaust ports are located at one and the same side, the front side, of the cylinder, and the opposite side of the cylinder wall is unported or continuous. The port arrangement is such that improved gas flow patterns are obtained with resultant improved scavenging and cooling of the piston dome and ring areas. The transfer port is of greater angular extent than either exhaust port and discharges onto the piston head between the exhaust ports.

Therefore, it is an object of this invention to provide a simple transfer and exhaust port system to help ensure a regular cooling of the piston crown and cylinder area where the exhaust port is located. Also to obtain an optimum filling of the cylinder with fresh fuel mixture from the crankcase.

It is another object of this innovation to provide more efficiency to the piston rings, so as to be more able to withstand the high thermal stresses involved, as a result of the greatly improved cooling conditions for the piston and cylinder in the areas where they are needed most.

It is a further object of this innovation to improve the scavenging efficiency of the fresh mixture of gasses displacing the burnt gasses through the exhaust ports, as the fresh gasses are vented into the cylinder from the crankcase. This results from reduced or low frictional resistance to gas transfer through a single, large flow path, as compared with transfer through several smaller flow paths, particularly, at high cycle speed.

Finally, it is an object of the present innovation to provide improved fuel economy since the front transfer port is a single transfer port.

Other advantages of the invention will be evident from the following detailed description when read in conjunction with the accompanying drawings which illustrate the invention.

DESCRIPTION OF THE INVENTION

Figure 1:
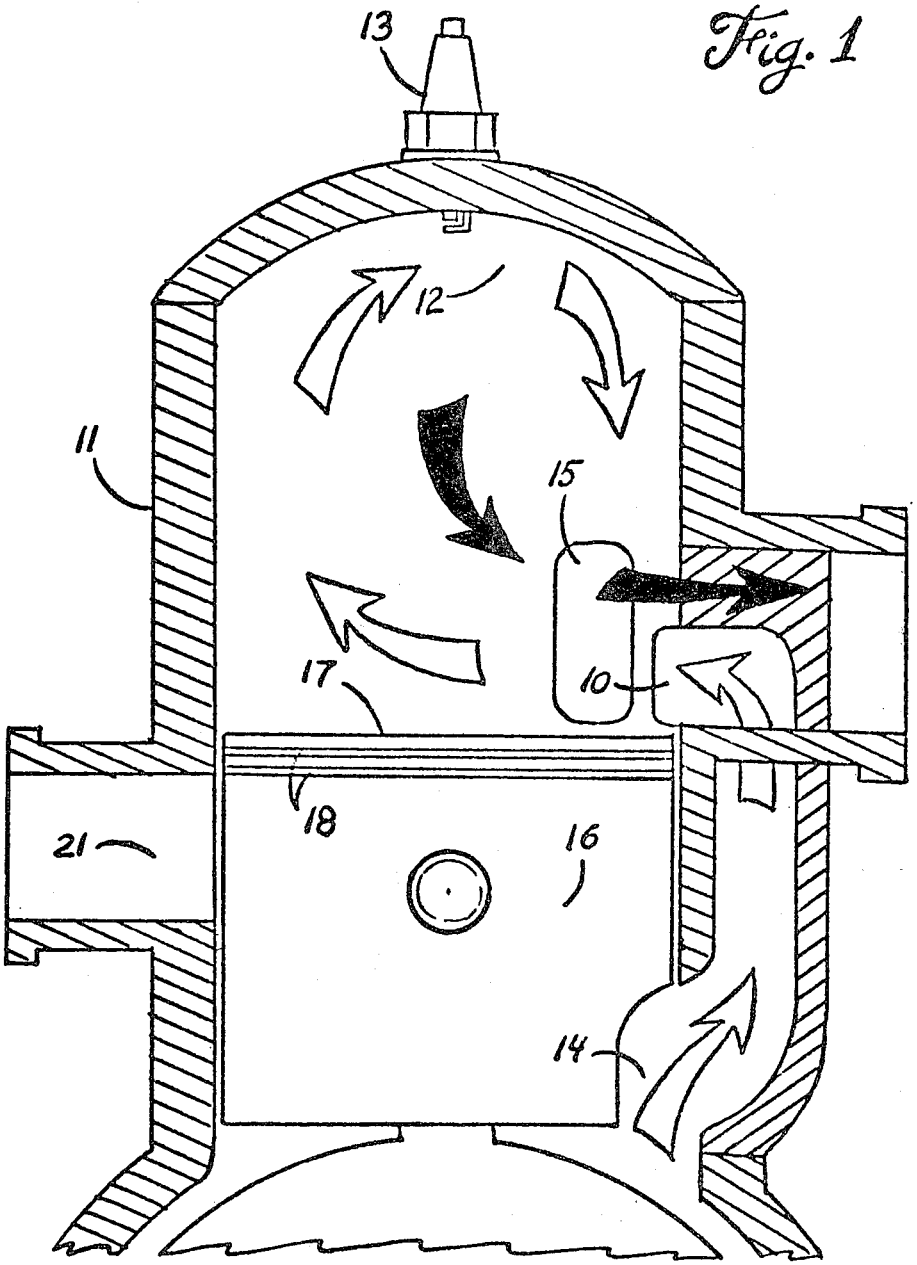
FIG. 1 illustrates the front transfer port system as utilized in conjunction with other parts of a two-stroke cycle engine, in longitudinal section of the cylinder.
Figure 2:
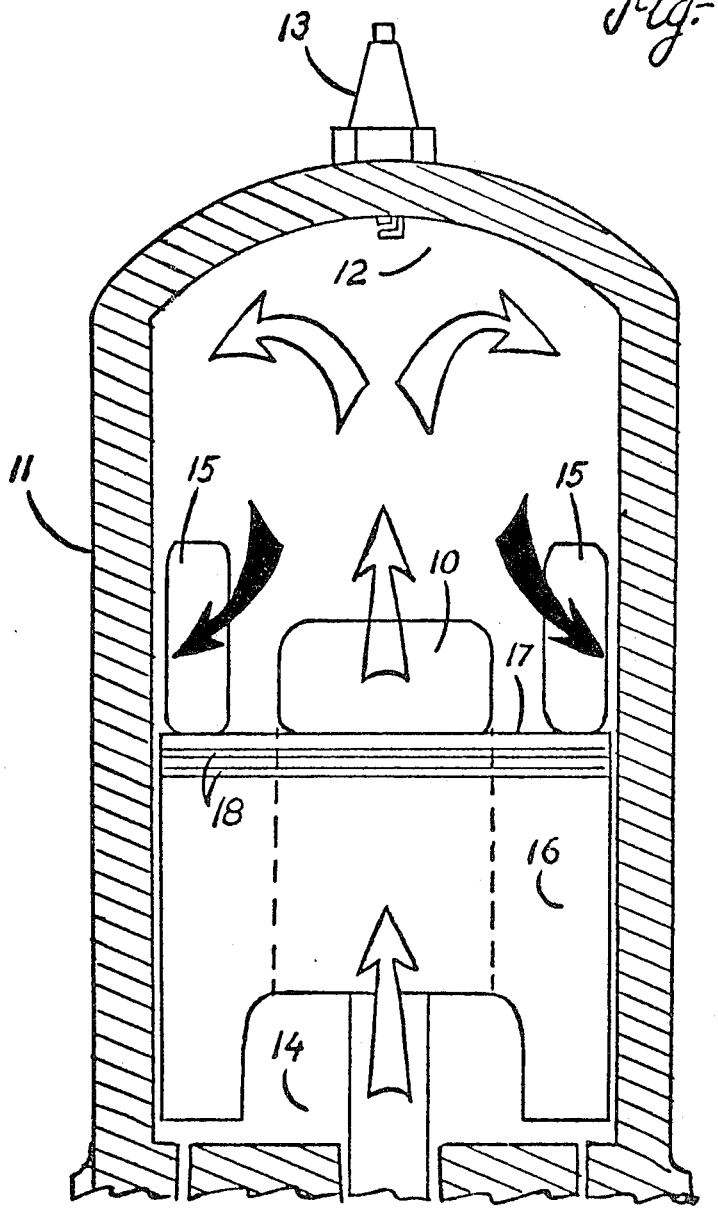
FIG. 2 illustrates the front transfer port system of FIG. 1 in longitudinal section of the cylinder looking towards the front transfer port.
Figure 3:
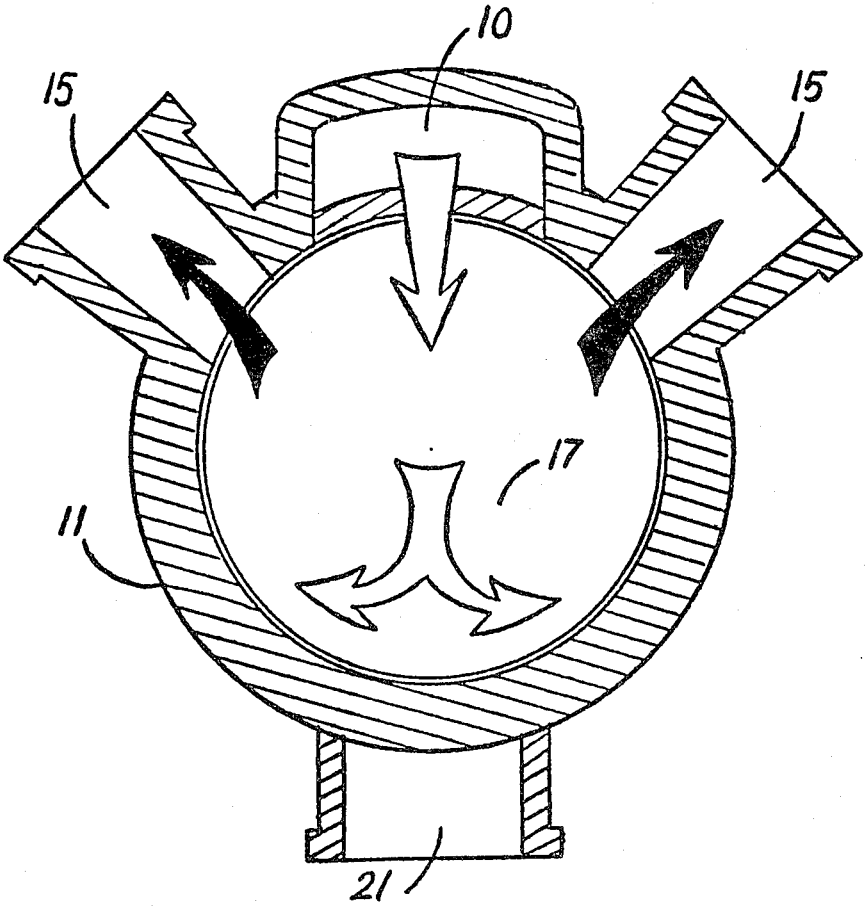
FIG. 3 illustrates the front transfer port system in horizontal section through the cylinder.

FIGS. 1, 2 and 3 illustrate the front transfer port system including a single transfer port 10 and a pair of exhaust ports 15 applied to an internal combustion two-stroke cycle engine according to the invention.

The basic operation of such two-stroke cycle engine is well known and the front transfer and spaced exhaust port system is adapted to provide optimum engine efficiency.

Each stroke of the piston 16 combines more than one of the four basic operations, induction and compression, combustion and exhaust, when it covers and uncovers, as required, the ports 10 and 15 in the cylinder wall 11.

With the piston 16 at the top of its stroke, there is a compressed fuel mixture above in the combustion chamber 12, the crankcase 14 has been sucked full of mixture through the inlet port 21, and the spark plug 13 is ready to be fired. As the piston 16 begins to descend after ignition, it closes the inlet port 21 and the fuel mixture in the crankcase is compressed. When the piston 16 nears the bottom of its stroke, the exhaust ports 15 are first opened and the burned gasses start to rush out. A moment later the transfer port 10 opens allowing the fresh fuel mixture in the crankcase 14, now compressed by descent of the piston 16, to pass up into the cylinder 11 via transfer passage and port 10, which is of such angular extent in the piston wall as to spread the incoming mixture across the region of the piston crown between the exhaust ports. As shown by the shaded arrows representing exhaust gas and the unshaded arrows representing fresh gas, the gas streams form at about the center of the piston crown, a single column, travelling up the rear of the cylinder wall 11 into the chamber 12, then spreading to fill the dome and push out the remaining burned gases, through the exhaust ports 15. As the piston 16 rises, it covers first the transfer port 10 and then the exhaust ports 15 which have a height greater than the transfer port. Rising further, it compresses the fuel mixture above and creates a vacuum in the crankcase 14, which is filled with a new supply of fresh fuel mixture when the piston 16 reaches the top of the cylinder 11 and uncovers the inlet port 21. Then a new cycle starts again.

One of the consequences between working cycles of an internal combustion two-stroke engines, is the high temperature accumulated by several parts of the same and the difficulty in obtaining an appropriate cooling for them.

The point where the temperature is more severe is in the frontal area of the piston crown and its rings in contact with the expanding burnt gasses leaving the cylinder through the exhaust ports.

The front transfer port system helps ensure an optimum cooling on the front of the piston crown and to the front of the cylinder wall where the exhaust ports are located. Also the rings are greatly benefitted by the cooling effect at that critical area of distortion in the piston caused by the heat of exhaust discharge.

The front transfer port system also improves fuel economy, when the single transfer port at the front of the cylinder is used. The losses of efficiency are minimum for the fresh charge of gases that transfer from the crankcase to the cylinder because of the better primary compression ratio and less pumping losses that occur with the practice of multiple transfer passages and ports.

From the foregoing and from reference to the drawings, it will be understood that the improved cooling effects can be attributed to the fact that the transfer port 10 provides a relatively large flow area for cooling gas flow from the crankcase into the cylinder, in the region between the angularly spaced exhaust ports 15, but at the same side of the cylinder wall 11, so that the maximum cooling effect is at the region of the piston head and rings most affected by heat.

The incoming gas flows, moreover, in a relatively non-turbulent manner, is indicated by the arrows, entering between the exhaust ports in opposite sides thereof, turning upwardly at the opposite side of the cylinder, then being turned forwardly to fill the upper cylinder and; turning downwardly towards the exhaust port, to assist in scavenging the burned gas through the exhaust ports.

Changes may be made in combination and arrangement of sizes of elements as heretofore set forth in this specification and shown in the drawings; it being understood, that changes may be made in the embodiments disclosed, without departing from the spirit and scope of the invention.

As is clearly seen in the drawing, the exhaust ports 15 extend outwardly from the cylinder substantially at right angles. As specifically shown, the apex of the right angle is somewhat rearward of the center of the cylinder, but the apex of the angle may be located at or near the center of the cylinder, in which case the angular relation of the exhaust ports 15 will be somewhat greater than right angular. It will also be noted that the sidewalls which define the outward extension of the exhaust ports both at the sides and at the top and bottom, are substantially parallel for a distance which is equal to or greater than the width of the exhaust ports at the inner cylinder wall. As specifically shown, the outward extension of the ports 15 from the cylinder wall is approximately the length of the radius of the cylinder.

Such angular relation of the exhaust ports, at opposite sides of the transfer port, combined with the outward extension of the sidewalls, in substantially parallel relation, for a significant distance, provides a flow path which is relatively free of sharp angular walls or obstructions to the free flow of the gas, so that the gas need not change directions for a substantial distance, thereby enhancing the non-turbulent flow.

I claim:

1. In a two-cycle engine comprising:

a crankcase; a cylinder; a piston reciprocable in said cylinder; an inlet to said crankcase; a transfer port from said crankcase to said cylinder; and a pair of exhaust ports from said cylinder; the improvement wherein said transfer port and said exhaust ports are located on the same side of said cylinder, with said exhaust ports angularly spaced at opposite sides of said transfer port; said transfer port having a larger angular extent than said exhaust ports and discharging gas onto said piston head between said exhaust ports; said exhaust ports being approximately at right angles and being defined by walls extending substantially parallel a distance at least equal to the width of the exhaust ports at the cylinder; said cylinder being unported at the side opposite to said transfer and exhaust ports.

2. In a two-cycle engine as defined in claim 1; said transfer and exhaust ports being located in the front half of said cylinder.

3. In a two-cycle engine engine as defined in claim 1; said walls of said exhaust ports being parallel for a distance approximately equal to the length of the radius of said cylinder.

* * * * *